US008800505B2

(12) United States Patent
Ichihashi

(10) Patent No.: US 8,800,505 B2
(45) Date of Patent: Aug. 12, 2014

(54) ENGINE POWER TOOL

(71) Applicant: Hitachi Koki Co., Ltd., Tokyo (JP)

(72) Inventor: Naoto Ichihashi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 13/789,489

(22) Filed: Mar. 7, 2013

(65) Prior Publication Data

US 2013/0239911 A1 Sep. 19, 2013

(30) Foreign Application Priority Data

Mar. 15, 2012 (JP) ..... 2012-058235
Sep. 28, 2012 (JP) ..... 2012-218615

(51) Int. Cl.
*F01P 1/02* (2006.01)

(52) U.S. Cl.
USPC ..... 123/41.7

(58) Field of Classification Search
CPC ... F01P 5/06; F01P 2001/02; F01P 2001/023; F01P 2001/026; F01P 1/02; F02B 63/02
USPC ..... 123/41.7, 195 C, 198 E, 41.31, 41.56; 181/264; 30/381–383
See application file for complete search history.

(56) References Cited

U.S. PATENT DOCUMENTS

| | | | | |
|---|---|---|---|---|
| 3,581,717 | A * | 6/1971 | Fullerton | 123/41.67 |
| 3,994,067 | A * | 11/1976 | Hazzard et al. | 30/383 |
| 4,592,445 | A * | 6/1986 | Sawada | 181/229 |
| 4,727,651 | A * | 3/1988 | Nakajima | 30/383 |
| 8,302,567 | B2 * | 11/2012 | Junginger | 123/41.7 |
| 2006/0107533 | A1 * | 5/2006 | Schlauch et al. | 30/381 |

FOREIGN PATENT DOCUMENTS

| | | |
|---|---|---|
| JP | 6-18622 | 3/1994 |

* cited by examiner

*Primary Examiner* — Hung Q Nguyen
(74) *Attorney, Agent, or Firm* — McDermott Will & Emery LLP

(57) ABSTRACT

An engine for rotating a saw chain serving as a rotating tool includes an engine main body including a crank case and cylinder. A cooling fan for generating forced cooling air is attached to a protruding end of a crank shaft. An engine cover for covering a top of the cylinder is provided in the engine, and an air guiding rib extending in a direction of crossing the cooling air is provided in an inner circumferential surface of the engine cover. In the engine cover, opening portions for exhausting the cooling air outside are provided.

15 Claims, 13 Drawing Sheets

ENGINE POWER TOOL

CROSS-REFERENCE TO RELATED APPLICATION

The present application claims priority from Japanese Patent Application No. 2012-058235 filed on Mar. 15, 2012, and Japanese Patent Application No. 2012-218615 filed on Sep. 28, 2012, the contents of which are hereby incorporated by reference into this application.

TECHNICAL FIELD OF THE INVENTION

The present invention relates to a portable engine power tool such as a chain saw or a power cutter.

BACKGROUND OF THE INVENTION

As a handheld-type, that is, portable-type engine power tool with using an engine as a driving source, there are a chain saw, a power cutter, and others. In the chain saw, a saw chain which is a chain-shaped saw blade for cutting a workpiece such as wood is provided in a power tool main body. In the power cutter, a disc cutter for cutting or creasing stone or concrete is provided in a power tool main body. An engine mounted on such an engine power tool includes an engine main body including: a crank case to which a crank shaft is attached so as to be rotatable; and a cylinder in which a piston is embedded so as to be linearly reciprocatable, and a cooling fan is attached to one protruding end of the crank shaft, so that it is a forced cooling engine. Cooling air generated by the cooling fan is blown along the engine toward a side of the engine opposite to the cooling fan, so that the engine is forcibly cooled. When the engine stops, the rotation of the cooling fan stops, and therefore, the engine is cooled by natural cooling after the engine stops.

In order to supply an air-fuel mixture of fuel and air to the engine, a carburetor is attached to the engine so as to interpose an insulator. When the engine stops, the flowing of the air-fuel mixture inside the carburetor and the insulator also stops. Therefore, a cooling effect of the carburetor and the insulator by the air-fuel mixture is lost, and therefore, heat conduction occurs from the cylinder to the carburetor through the insulator so as to increase a temperature of the carburetor. If the increase in the temperature of the carburetor is too large, most of gasoline (petrol), that is, fuel, is vaporized, and therefore, a sufficient amount of the fuel cannot be supplied from the carburetor to the engine, which results in difficulty in restart of the engine. More particularly, downsizing is strongly demanded for the engine used for the portable engine power tool, and therefore, it is required to make the insulator as short as possible. Therefore, in the portable engine power tool, it is not only required to efficiently perform the forced cooling in the engine operation but also required to promote the natural cooling for the cylinder and the insulator so as to reduce the increase in the temperature of the carburetor in order to suppress the increase in the temperature of the carburetor without making the insulator long, and the requirement is an important technical problem.

Japanese Utility-Model Application Laid-Open Publication No. H06-18622 (Patent Document 1) describes an engine in which the cooling air passing through a spark plug is regulated by suspending an air guiding rib toward the cylinder on an upstream side of the spark plug so as to form a small space between the cylinder and the air guiding rib.

SUMMARY OF THE INVENTION

However, if the cooling air passing through the spark plug is regulated by the air guiding rib, the cooling air is hardly guided to a heat dissipating fin in the cylinder on a downstream side of the spark plug, and the cooling air is exhausted outside from an opening portion formed in a spark plug cover, and therefore, the forced cooling cannot be effectively performed. On the other hand, when the engine stops, airflow of natural convection occurs from the heat dissipating fin of the cylinder upward in a gravity direction, so that the natural cooling for the engine is performed. However, in order to effectively perform the forced cooling, if the air guiding rib is provided adjacent to a top fin so as to be almost in contact therewith, it results in such a vicious circle as degradation in efficiency of the natural cooling. Further, if the cooling air passing through the spark plug is regulated by the air guiding rib, the airflow of the natural convection is also regulated by the air guiding rib. Therefore, even if the opening portion having a relatively large area for exposing the spark plug therefrom is formed in the cover, the natural cooling cannot be performed by this opening portion. Besides, an effective area of the opening portion for the natural cooling is a projected area in a plan view, and therefore, the opening portion formed in the inclined spark plug cover cannot be effectively utilized for the natural cooling.

In the engine power tool such as the chain saw or the power cutter, generally, a handle to be held by a worker to hold is provided above the cylinder. Therefore, depending on a position of the opening portion, ascending air current of the natural convection at a high temperature is in contact with the handle or a hand of the worker holding the handle in the engine step, which results in a risk of workability loss. Further, in the chain saw, in order to be compact, a fuel tank cap is generally provided onto the cooling fan side. Therefore, for refueling in the engine stop after the chain saw is used, the engine main body often lies on its side, that is, is put in a lateral orientation. Therefore, even in the lateral orientation in the refueling or others, it is required to effectively perform the natural cooling. In a conventional engine power tool, cooling efficiency in such a lateral orientation is insufficient.

As described above, in the engine of the conventional engine power tool, the cooling efficiency of the engine cannot be enhanced by performing both of the forced cooling in the engine operation and the natural cooling for engine residual heat in the engine stop.

A preferred aim of the present invention is to improve the cooling efficiency of the engine.

An engine power tool according to an embodiment of the present invention includes: an engine main body formed of a crank case in which a crank shaft is embedded so as to be rotatable and a cylinder in which a piston for rotating the crank shaft is embedded so as to be reciprocatable; and a power tool main body to which a rotating tool rotated by the crank shaft is attached. The engine power tool further includes: a cooling fan which is attached to one protruding end of the crank shaft and which generates forced cooling air; an engine cover in which an exhaust port for the forced cooling air is provided in the other protruding end of the crankshaft and which covers a top of the engine main body; and an air guiding rib which is provided in an inner surface of the engine cover so as to protrude therefrom and so as to extend in a direction of crossing the forced cooling air flowing from along the cylinder the protruding end of the crank shaft toward an opposite side thereof, and an opening portion which is formed so as to externally open a downstream side of the forced cooling air with respect to the air guiding rib is provided in the engine cover.

In the engine, the cooling fan is provided at the one protruding end of the crank shaft in order to generate the cooling air toward the cylinder, and the cooling air is supplied toward the other end side of the crank shaft. The air guiding rib is provided in the inner surface of the engine cover which covers the top of the cylinder so as to extend in the direction of crossing the forced cooling air discharged from the cooling fan, and the opening portion is provided on the downstream side of the air guiding rib. In this manner, the forced cooling air is guided along the cylinder toward the opposite side to the cooling fan of the engine cover without exhausting the forced cooling air outside from the opening portion, so that the engine can be efficiently cooled by the forced cooling air in the engine driving. On the other hand, in the engine stop, the ascending air current caused by the residual heat of the engine is exhausted outside from the opening portion provided on the cylinder cover, and therefore, the natural cooling for the engine can be efficiently performed. As described above, both of the forced cooling and the natural cooling for the engine can be achieved, so that the cooling effect of the engine can be improved.

BRIEF DESCRIPTIONS OF THE DRAWINGS

DESCRIPTIONS OF THE PREFERRED EMBODIMENTS

Figure 2:
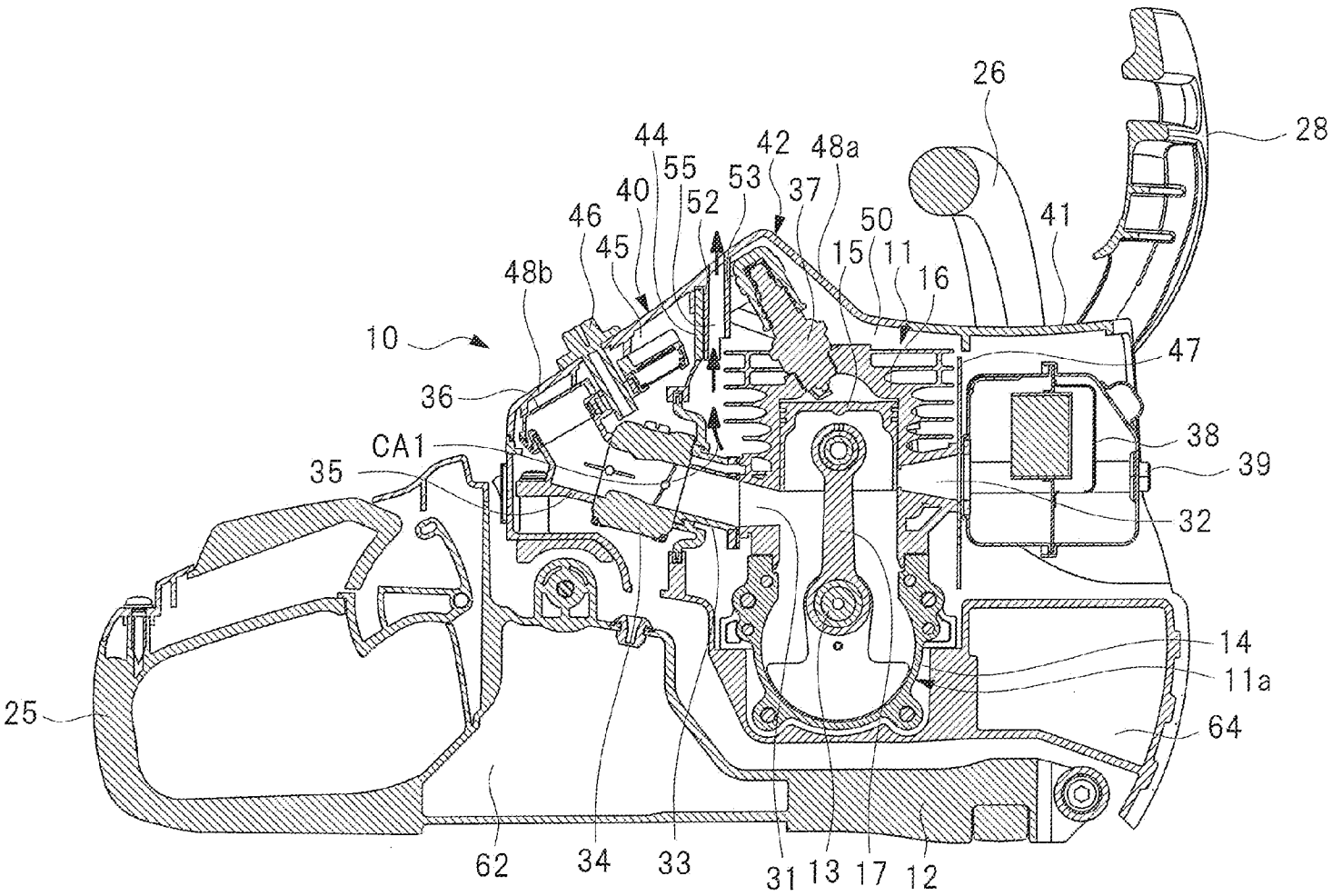
FIG. 2 is a cross-sectional view taken along a line A-A in FIG. 1.

Hereinafter, embodiments of the present invention will be explained in detail based on the drawings. A chain saw 10 serving as an engine power tool includes a power tool main body 12 in which an engine 11 is embedded as illustrated in FIG. 2. The engine 11 includes an engine main body 11*a* formed of a crank case 14 in which a driving shaft, that is, a crank shaft 13, is embedded so as to be rotatable and a cylinder 16 in which a piston 15 is embedded so as to be linearly reciprocatable. Each of the crank case 14 and the cylinder 16 is made of aluminum alloy. The piston 15 is coupled to the crank shaft 13 by a connecting rod 17, and the reciprocating movement of the piston 15 is converted into rotational movement of the crank shaft 13 through the connecting rod 17.

Figure 3:
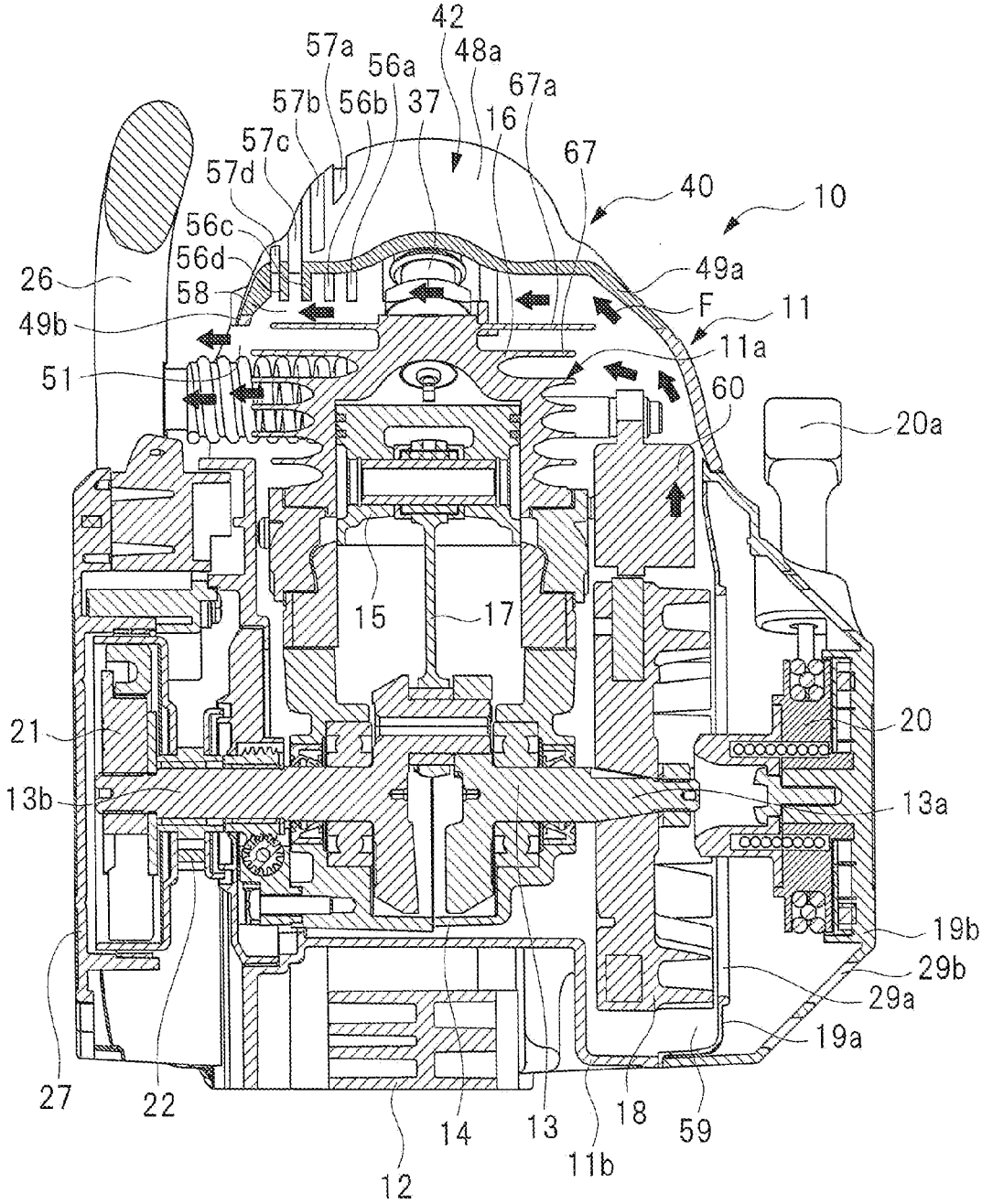
FIG. 3 is a cross-sectional view taken along a line B-B in FIG. 1, illustrating flow of cooling air in forced cooling in engine operation.
Figure 4:
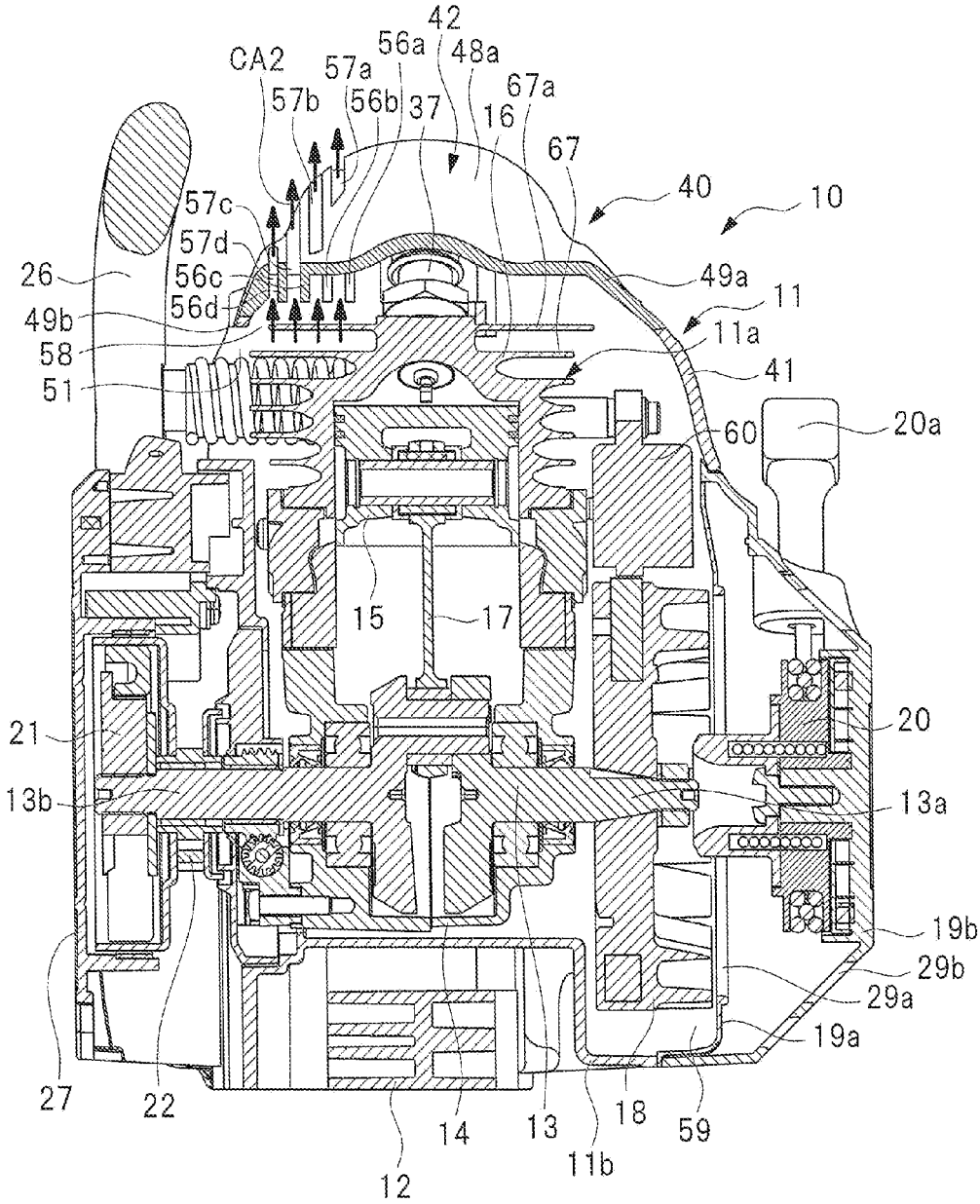
FIG. 4 is a cross-sectional view taken along the line B-B in FIG. 1, illustrating flow of cooling air in natural cooling in engine stop with putting the chain saw in a normal standing state.

As illustrated in FIGS. 3 and 4, a cooling fan 18 is attached to one protruding end 13*a* of the crank shaft 13. The cooling fan 18 is housed inside an engine case 11*b* attached to the power tool main body 12. The cooling fan 18 is covered with a fan cover 19*a* attached to the engine case 11*b*, and a fan case 19*b* is attached outside the fan cover 19*a*. Inside the fan case 19*b*, a starting device, that is, a recoil starter 20, is provided, and the engine 11 is started by operating a starting grip 20*a*. A sprocket 22 is coupled to the other protruding end 13*b* of the crank shaft 13 through a centrifugal clutch 21, and the sprocket 22 is attached to the crank shaft 13 so as to be rotatable thereto. As indicated by a two-dot chain line in FIG. 1, a guide bar 23 is attached to the power tool main body 12. A saw chain 24 serving as a rotational tool is attached around the guide bar 23, the saw chain 24 is hooked around the sprocket 22, and the saw chain 24 is rotated by the engine 11 through the centrifugal clutch 21. As described above, the one protruding end 13*a* side of the crank shaft 13 is a fan driving side end, and the opposite-side protruding end 13*b* thereof is a tool driving side end, that is, an output side end.

In the engine main body 11*a*, the crank shaft 13 is attached to the power tool main body 12 in a lateral direction with respect to the power tool main body 12. A rear handle 25 is provided at the rear of the power tool main body 12 so as to protrude rearward. A front handle 26 serving as an operation handle is arranged in the power tool main body 12 from the one protruding end 13*a* side of the crank shaft 13 to the other-side protruding end 13*b* thereof so as to be across the engine 11. One end of the front handle 26, that is, a leg portion 26*a* on the fan side is fixed to one front end of the power tool main body 12, and the other end thereof, that is, a leg portion 26*b* on the tool driving side is fixed to the rear handle 25. A distance between the leg portion 26*b* of the front handle 26 on the tool driving side and the cylinder 16 is set shorter than a distance between the leg portion 26*a* thereof on the fan side and the cylinder 16, and therefore, the worker performs a cutting operation for a workpiece such as wood with the chain saw 10 with holding the front handle 25 with his/her right hand and holding a side part of the front handle 26 with his/her left hand. On the tool driving side of the power tool main body 12, a side cover 27 for covering the centrifugal clutch 21 and the sprocket 22 is attached. The worker performs the operation with holding the side part of the front handle 26, that is, the cooling fan 18 side without holding the leg portion 26*b* on the rotational tool side where the saw chain 24 serving as the rotational tool rotating at a high speed is arranged. In the power tool main body 12, a hand guard 28 protruding frontward more than the front handle 26 is provided.

As illustrated in FIG. 2, the cylinder 16 includes an intake port 31 opened toward the rear side of the power tool main body 12 in a right angle direction with respect to the crank shaft 13, and includes an exhaust port 32 opened toward the front side of the power tool main body 12 which is opposite to the intake port 31. An insulator 33 provided with a flow path communicating with the intake port 31 is attached to the cylinder 16, and a carburetor 34 is attached to the insulator 33. The insulator 33 has heat resistance, and is made of polymer resin having a thermal conductivity extremely smaller than that of the cylinder 16, so that heat transfer from the cylinder 16 to the carburetor 34 is prevented. A cleaner support part 35 is provided on an inlet side of the carburetor 34, and a filter element 36 is attached to this cleaner support part 35. The outside air cleaned by the filter and the fuel from a fuel tank not illustrated are supplied to the carburetor 34, the carburetor 34 generates an air-fuel mixture of the air and the fuel, and the air-fuel mixture is supplied from the intake port 31 into the engine main body 11*a*. The supplied air-fuel mixture is ignited by a spark plug 37. A muffler 38 is attached to the cylinder 16 by a bolt 39 so as to communicate with the exhaust port 32, and the combustion gas exhausted from the exhaust port 32 is exhausted outside through the muffler 38.

Figure 5:
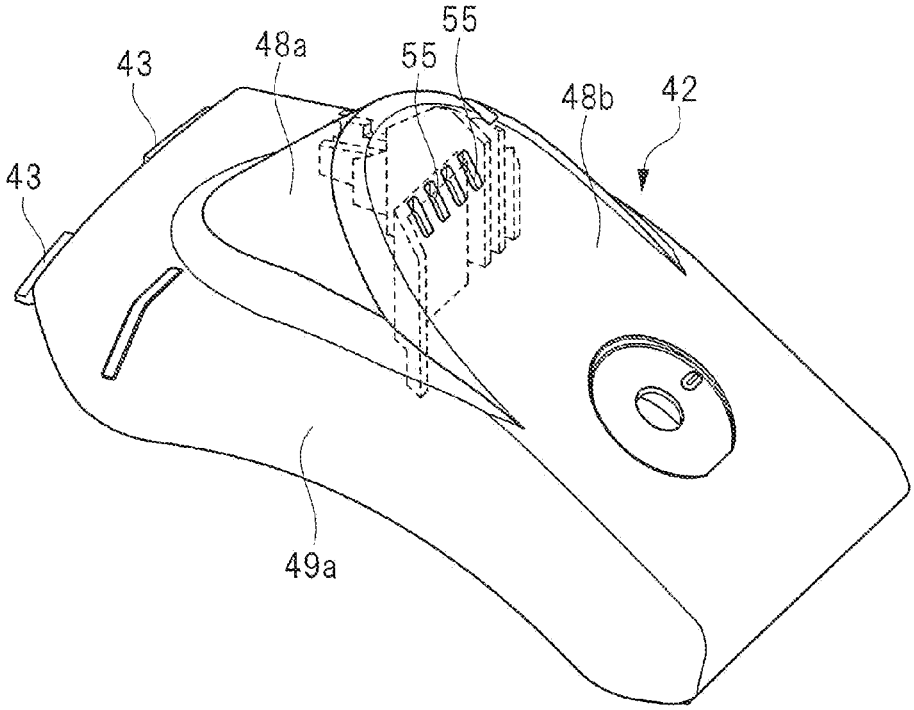
FIG. 5 is a perspective view illustrating an outer surface of a cylinder cover illustrated in FIG. 1.
Figure 6:
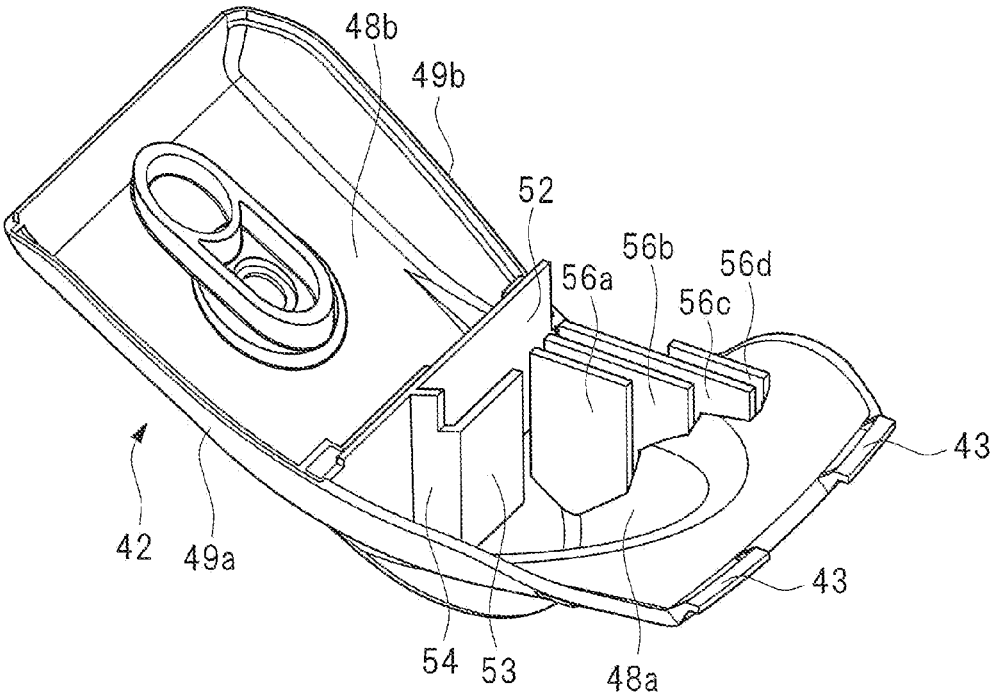
FIG. 6 is a perspective view illustrating an inner surface of the cylinder cover.

An engine cover 40 is attached to the engine case 11*b*, and the engine main body 11*a* is covered with the engine cover 40. A space is provided between the engine cover 40 and the front handle 26, and the front handle 26 is provided so as to cross the engine cover 40 through the space. The engine cover 40 includes a cover distal-end part 41 and a cylinder cover 42 attached thereto, and the cylinder cover 42 covers a top of the cylinder 16. As illustrated in FIGS. 5 and 6, an engaging protruding part 43 engaged with the cover distal-end part 41 is provided at a tip of the cylinder cover 42. The filter element 36 is covered with the cylinder cover 42, and a heat shield plate 44 is provided between the insulator 33 and the carburetor 34. A carburetor chamber 45 is formed of the heat shield plate 44 and the cylinder cover 42, and the carburetor 34 is housed inside the carburetor chamber 45. By embedding the carburetor 34 inside the carburetor chamber 45, entering of woodchip, dust, and others into the carburetor 34 is prevented, so that pollution of the carburetor 34 and the filter element 36 is suppressed. The cylinder cover 42 is attached to the engine 11 by a setscrew 46.

Figure 1:
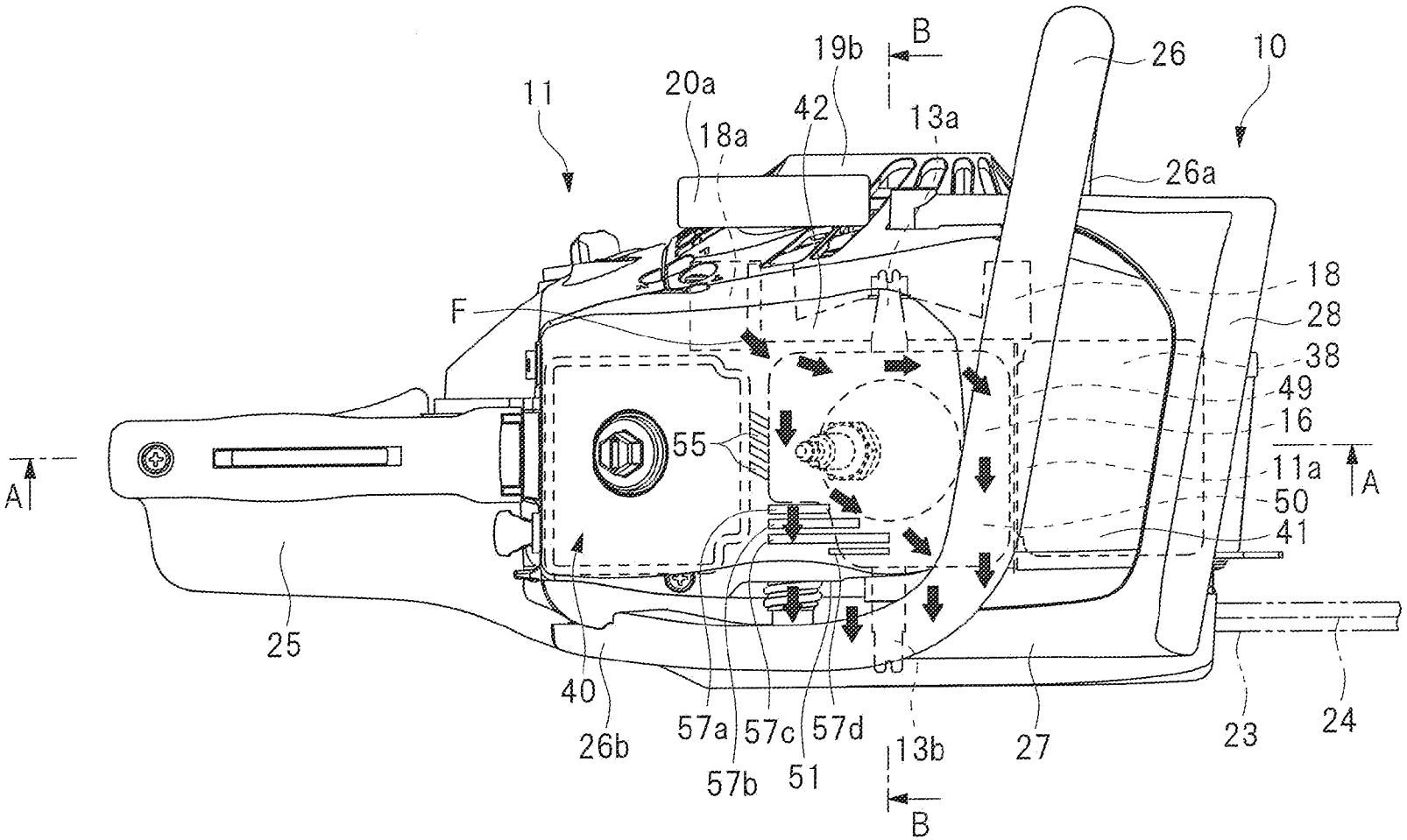
FIG. 1 is a plan view illustrating a chain saw serving as an engine power tool of an embodiment.

As illustrated in FIG. 1, a cooling-air discharge port 18*a* of the cooling fan 18 is opened toward the cylinder cover 42. When the cooling fan 18 is driven, the outside air flows from a vent port 29*b* of the fan case 19*b* into an intake port 29*a* of the fan cover 19*a* so that the forced cooling air "F" is generated by the cooling fan 18. The generated forced cooling air F is discharged toward the cylinder cover 42. A heat radiator plate 47 attached onto the exhaust port 32 side of the cylinder 16 as illustrated in FIG. 2, and the forced cooling air F generated by the cooling fan 18 and discharged from the cooling-air discharge port 18*a* passes through an engine cooling chamber 50 formed of the heat shield plate 44, the heat radiator plate 47, and the cylinder 16, and is exhausted outside from an exhausted port 51 provided on the tool driving end side of the engine cover 40 as indicated by arrows in FIG. 1. A flow direction of the forced cooling air F flowing along the inner surface of the cylinder cover 42 is indicated by arrows in FIG. 7.

Figure 7:
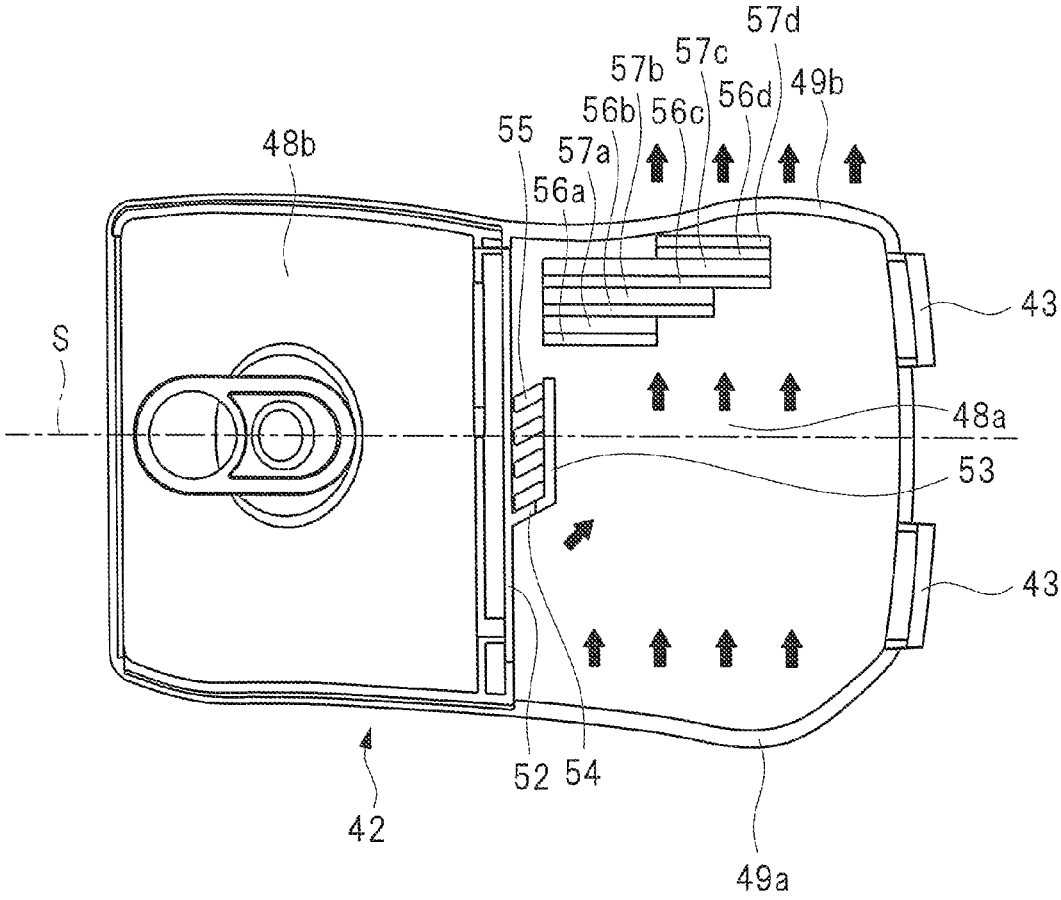
FIG. 7 is a plan view of FIG. 6.

As illustrated in FIGS. 2 and 5, a center part of the cylinder cover 42 in a width direction includes: a front-side inclined wall part 48*a* inclined downward toward the front of the engine 11; and a rear-side inclined wall part 48*b* inclined downward toward the rear of the engine 11. On the fan side of the cylinder cover 42, an inclined side wall part 49*a* inclined so as to spread toward the engine 11 is provided. As illustrated in FIGS. 7 and 6, a notch 49*b* is provided on an output side of the cylinder cover 42, and the exhaust port 51 is formed between the notch 49*b* and the engine case 11*b*.

As illustrated in FIGS. 6 and 7, a partition plate 52 is provided on the inner surface of the cylinder cover 42 in a width direction of the cylinder cover 42, that is, a direction along the crankshaft 13, and this partition plate 52 abuts on the heat shield plate 44 illustrated in FIG. 2. In a center part of the inner surface of the cylinder cover 42 in the width direction, an air guiding plate 53 is provided so as to extend in parallel with the partition plate 52 and to protrude form the inner surface of the cylinder cover 42. An air guiding rib 54 is integrally provided on an uppermost-stream side of the forced cooling air of this air guiding plate 53, and the air guiding rib 54 extends in a direction of crossing the air flowing in the width direction of the engine cover 40 as the forced cooling air or others so as to continue between the partition plate 52 and the air guiding plate 53. When it is set that a longitudinal direction line in a right angle direction with respect to the crank shaft 13 in FIG. 7 is indicated by "S", the air guiding rib 54 is inclined with respect to this longitudinal direction line S. This inclined direction is a direction in which a tip side of the engine cover 40 of the air guiding rib 54 is on a downstream side of the forced cooling air F.

Four opening portions 55 are provided at an interval on the downstream side of the forced cooling air in the air guiding rib 54. Through each of the opening portions 55, the inside of the cylinder cover 42 is communicated with outside in the front-side inclined wall part 48*a*. The opening portions 55 are aligned on the downstream side of the air guiding rib 54 along a direction in which the air guiding plate 53 extends, and each of the opening portions 55 is opened in vicinity of a distal-end part of the air guiding plate 53. As described above, since the opening portions 55 are provided on the downstream side of the air guiding rib 54, the exhaust of the forced cooling air outside from the opening portions 55 is prevented by the air guiding rib 54. The forced cooling air which has been hit the air guiding rib 54 is guided by the air guiding rib 54 to a front side of an upper surface of the cylinder 16. The air guiding rib 54 and each of the opening portions 55 face the insulator 33 attached to the intake port 31 as illustrated in FIG. 2, so that the natural cooling air "CA1" which is the ascending air current of the natural convection caused by the residual heat of the cylinder 16 in the engine stop is exhausted outside from the opening portions 55. In this manner, the residual heat is rapidly exhausted by the natural cooling.

As illustrated in FIGS. 3 and 7, four air guiding ribs 56*a* to 56*d* protrude from the inner surface of the cylinder cover 42 so as to be positioned on the downstream side of the forced cooling air F further than the spark plug 37, and each of the air guiding ribs 56*a* to 56*d* extends in the direction of crossing the forced cooling air F. As illustrated in FIG. 7, the air guiding ribs 56*a* to 56*d* are arranged in parallel with each other so as to be almost in parallel with the longitudinal direction line S and to be distant away from each other at an interval. As illustrated in FIG. 7, among the four air guiding ribs 56*a* to 56*d*, three air guiding ribs 56*a* to 56*c* viewed from the uppermost-stream side have respective side surfaces on the partition plate 52 side which are positioned on an extension line of the air guiding plate 53, and have respective opposite side surfaces which protrude toward the front of the engine 11 so that each protruding is stepwise from the upstream side to the downstream side. A front side surface of the air guiding rib 56*d* on the lowermost-stream side almost corresponds with the side surface of the air guiding rib 56*c* adjacent thereto. Opening portions 57*a* to 57*d* are formed in the front-side inclined wall part 48*a* of the cylinder cover 42 so as to be positioned on a downstream side of each of the air guiding ribs 56*a* to 56*d*. The opening portions 57*a* to 57*d* are long holes provided on the downstream side of the air guiding ribs 56*a* to 56*d* which are in vicinity of the distal-end part of the cylinder cover 42 of the air guiding ribs 56*a* to 56*d*, the long holes having lengths corresponding to respective dimensional widths of the air guiding ribs 56*a* to 56*d* in the longitudinal direction.

As described above, the opening portions 57*a* to 57*d* are provided on the downstream side of the air guiding ribs 56*a* to

56*d*, and therefore, the exhaust of the forced cooling air outside from the opening portions 57*a* to 57*d* is prevented by the air guiding ribs 56*a* to 56*d*. A part of the forced cooling air which has hit the air guiding ribs 56*a* to 56*d* flows to the exhaust port 51 through a flow path 58 formed between tip surfaces of the air guiding ribs 56*a* to 56*d* and the upper surface of the cylinder 16, and the other part thereof is guided by the air guiding ribs 56*a* to 56*d* to a front side of the upper surface of the cylinder 16. As illustrated in FIGS. 3 and 4, the air guiding ribs 56*a* to 56*d* and their opening portions 57*a* to 57*d* face an upper surface of the cylinder 16 on an opposite side of the cooling fan 18, so that the natural cooling air CA2 which is the ascending air current of the natural convection caused by the residual heat of the cylinder 16 in the engine step is exhausted outside from the opening portions 57*a* to 57*d*. In this manner, the residual heat is rapidly exhausted outside by the natural cooling.

As illustrated, the air guiding rib 54 and the opening portions 55 opposite to the insulator 33 are provided in the cylinder cover 42, and besides, the air guiding ribs 56*a* to 56*d* and the opening portions 57*a* to 57*d* are provided on the downstream side of the forced cooling air lower than the spark plug 37, so that the air guiding rib 54 and the opening portions 55 are an air guiding rib and opening portions on the upstream side, respectively. On the other hand, the air guiding ribs 56*a* to 56*d* and the opening portions 57*a* to 57*d* are air guiding ribs and opening portions on the downstream side.

The number of the air guiding rib 54 on the upstream side is only one. However, if the air guiding rib 54 is provided on the upstream side of the forced cooling air so as to correspond to each of the four opening portions 55, four air guiding ribs are provided on the upstream side. Conversely, the four air guiding ribs 56*a* to 56*d* are provided on the downstream side. However, if one air guiding rib is provided on the uppermost stream side, the number of the air guiding rib on the downstream side is one. Further, a natural heat radiation effect can be enhanced by providing a plurality of opening portions on the upstream side and the downstream side as illustrated further than that in a form in which the number of the opening portion is one for each of the upstream side and the downstream side. Each of the number of opening portions on the upstream side and the downstream side is not limited to four but set as any number.

When the engine 11 is driven, the cooling fan 18 is rotated to generate the airflow. The airflow is guided from a volute chamber 59 formed of the engine case 11*b* and the fan cover 19*a* to the cooling-air discharge port 18*a*. The forced cooling air F which has been discharged from the cooling-air discharge port 18*a* flows along an ignition coil 60, and then, is guided to the cylinder 16 by the engine cover 40 as indicated by arrows in FIGS. 1 and 3 to cool the cylinder 16, and then, is exhausted outside from the exhaust port 51. At this time, the forced cooling air F flows upward from the cooling-air discharge port 18*a* first, and is deflected toward the cylinder 16 by the cylinder cover 42. Then, as illustrated in FIG. 1, the forced cooling air F is guided from the carburetor chamber 45 side to the cylinder 16 side by the air guiding rib 54 to go toward the front side part of the cylinder 16. In this manner, the exhaust of the forced cooling air F outside through a space between the cylinder 16 and the carburetor chamber 45 so as not to cool the cylinder 16 is prevented, and therefore, the forced cooling air is exactly guided toward the cylinder 16 so as to effectively perform the forced cooling for the engine 11.

When the forced cooling air F is flowing along the cylinder 16, the forced cooling air F is not exhausted outside from each of the opening portions since the opening portions 55 and 57*a* to 57*d* are provided on the downstream side lower than the cooling-air discharge port 18*a*, and besides, the air guiding ribs 54 and 56*a* to 56*d* are provided on the upstream side of the opening portions 55 and 57*a* to 57*d*. After the forced cooling air F passes through the spark plug 37, it goes around toward a rear side of the spark plug 37 by the air guiding ribs 56*a* to 56*d*. In this manner, the cooling-air downstream side of the spark plug 37 and the cooling-air downstream side of the cylinder 16 can be effectively cooled. Also, since the flow path 58 is formed between the tip surfaces of the plurality of paralleled air guiding ribs 56*a* to 56*d* and the cylinder 16, the forced cooling air F is guided along the upper surface of the cylinder 16. Since the air guiding ribs 56*a* to 56*d* are provided on the upstream side of the respective opening portions 57*a* to 57*d*, leakage of the forced cooling air outside from the opening portions 57*a* and 57*d* is prevented, so that the cooling effect for the engine 11 by the forced cooling air F is not reduced. Each of the air guiding ribs 56*a* to 56*d* does not have a length crossing the entire forced cooling air, and therefore, even if woodchip or others enters the inside of the cylinder cover 42 from the opening portions 57*a* to 57*d*, it is immediately exhausted outside by the forced cooling air which flows forward further than the front ends of the air guiding ribs 56*a* to 56*d*. In this manner, foreign substances such as woodchip are prevented from staying inside the cylinder cover 42.

When the driving of the engine 11 stops, the rotation of the cooling fan 18 stops, and the airflow of the forced cooling air stops. At this time, the residual heat of the engine 11 is radiated by the natural cooling caused by the natural convection. The natural cooling air "CA1" and "CA2" which are ascending air current caused by the natural convection are generated from periphery of components which have received the residual heat of the cylinder 16 or the cylinder 16 having a high temperature as indicated by arrows in FIGS. 2 and 4, and flows upward. At this time, since each of the opening portions 55 and 57*a* to 57*d* is opened in up/down direction, the airflow generated from the periphery of the cylinder 16 or others is exhausted outside without interference. In this manner, the heat does not stay inside the cylinder cover 42, and therefore, the natural cooling for the cylinder 16 and the insulator 33 can be effectively performed. Also, the residual heat of the cylinder 16 is difficult to transfer to the carburetor 34 through the insulator 33, and therefore, the increase in the temperature of the carburetor 34 can be effectively reduced.

Further, each opening portion is formed so as to be shifted from the front handle 26 to the rear side of the power tool main body 12 with centering the crank shaft 13, and the front handle 26 goes around toward the front side of each opening portion, and therefore, the airflow of the natural convection is not in contact with the front handle 26 and the worker's hand holding the front handle 26, and the workability of the engine power tool is not lost. Also, with taking a center part of the cylinder cover 42 in the width direction as a boundary, it is set that a total opening area on the cooling fan side is smaller than a total opening area on an opposite side thereto, that is, the opposite side to the cooling fan 18, and therefore, the airflow of the natural convection is exhausted more to the protruding end 13*b* side of the crank shaft 13, and it is extremely rare that the airflow of the natural convection is in contact with the worker's hand operating the start grip 20*a* of the recoil starter 20 provided on the cooling fan 18 side, and the restarting operation of the chain saw 10 is not prevented.

FIGS. 8 to 15 illustrate a chain saw as an engine power tool of another embodiment. In these drawings, members common to the members configuring the chain saw illustrated in FIGS. 1 to 7 are denoted by the same reference symbols.

A chain saw 10 illustrated in FIGS. 8 to 15 is identical to the above-described chain saw except that a structure of the engine cover 40 is different from that of the engine cover 40 illustrated in FIGS. 1 to 7, and explanation of the overlapped portions is omitted.

Figure 9:
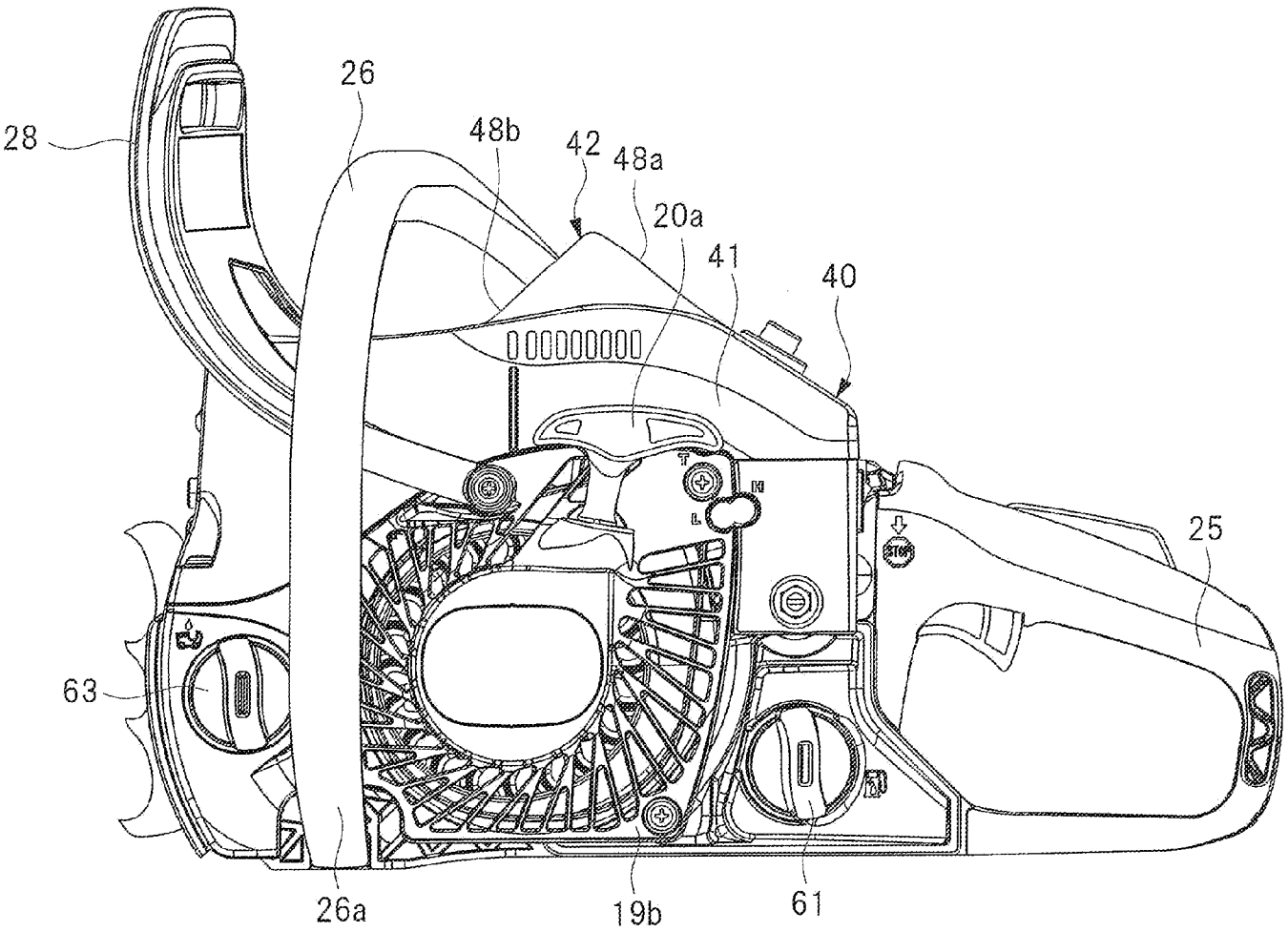
FIG. 9 is a rear view of the chain saw viewed from an arrow C direction in FIG. 8.

As illustrated in FIG. 9, a fuel tank cap 61 is arranged on a side surface of the engine 11 on a fan side. As illustrated in FIG. 2, a fuel tank 62 is provided below the carburetor 34, and the fuel supply into the fuel tank 62 is performed with putting the power tool main body 12 in a lateral state in which the side surface of the engine 11 on the fan side is oriented upward. In this lateral state, the crank shaft 13 is oriented in the up/down direction. Further, on the side surface of the engine 11 on the fan side, an oil tank cap 63 is arranged. An oil tank 64 for storing lubricating oil is provided below the muffler 38 as illustrated in FIG. 2, and the lubricating oil is supplied to a driving device by an oil pump not illustrated.

Figure 12:
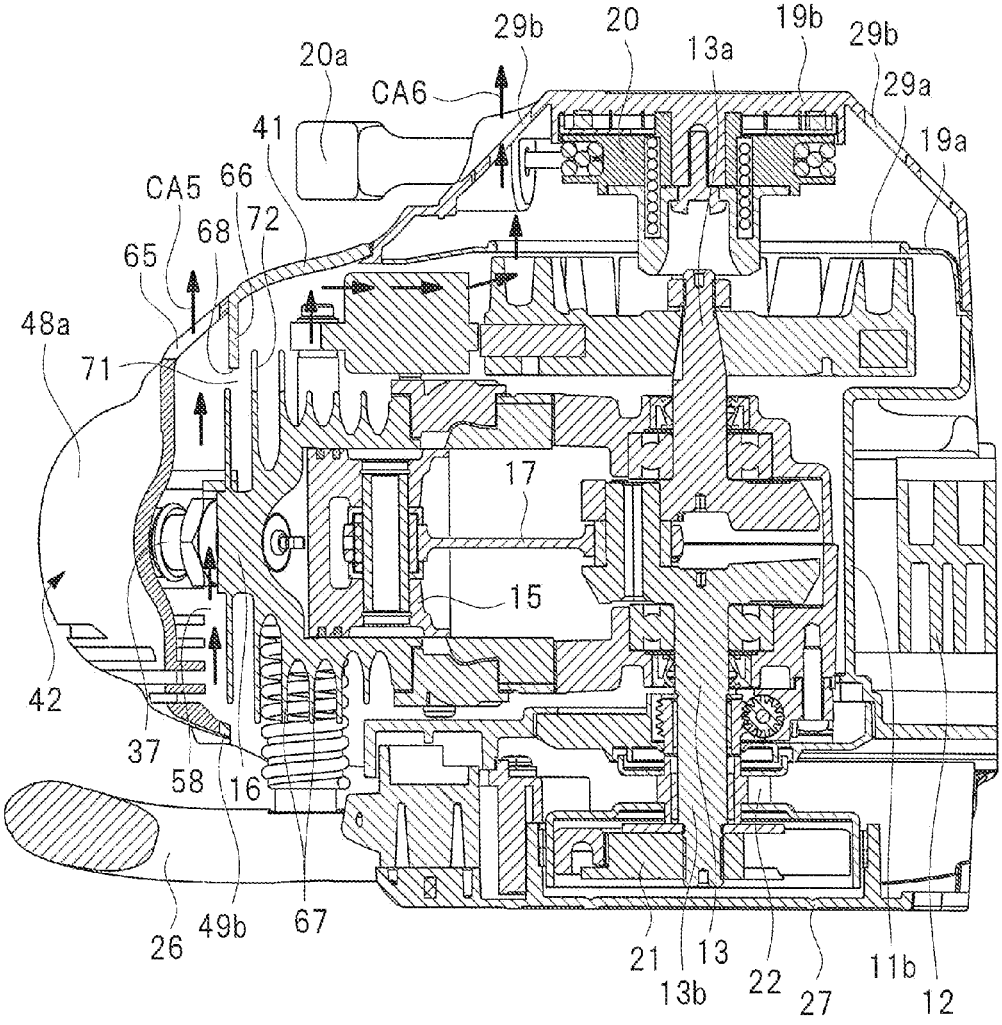
FIG. 12 is a cross-sectional view taken along the line D-D in FIG. 8, illustrating flow of cooling air in natural cooling in engine stop with putting the chain saw in a lateral orienting state.
Figure 13:
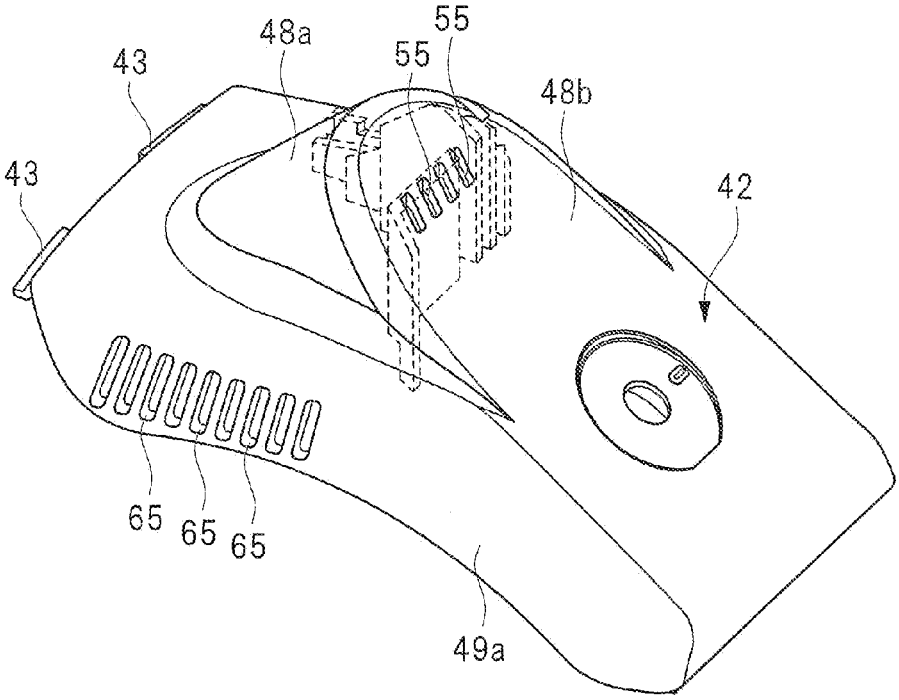
FIG. 13 is a perspective view illustrating an outer surface of a cylinder cover illustrated in FIG. 8.
Figure 14:
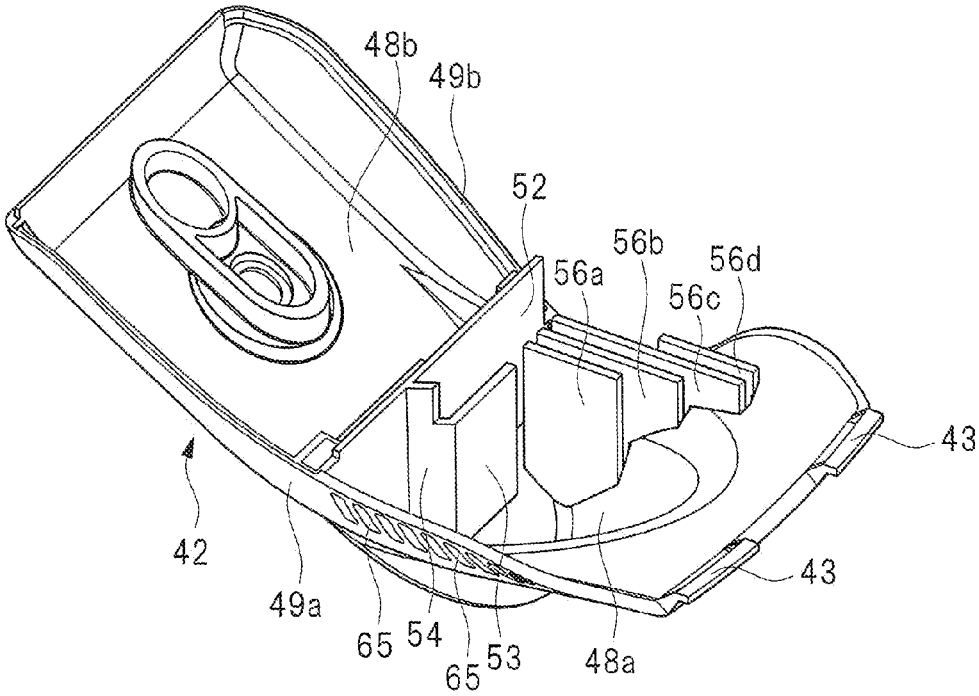
FIG. 14 is a perspective view illustrating an inner surface of the cylinder cover.
Figure 15:
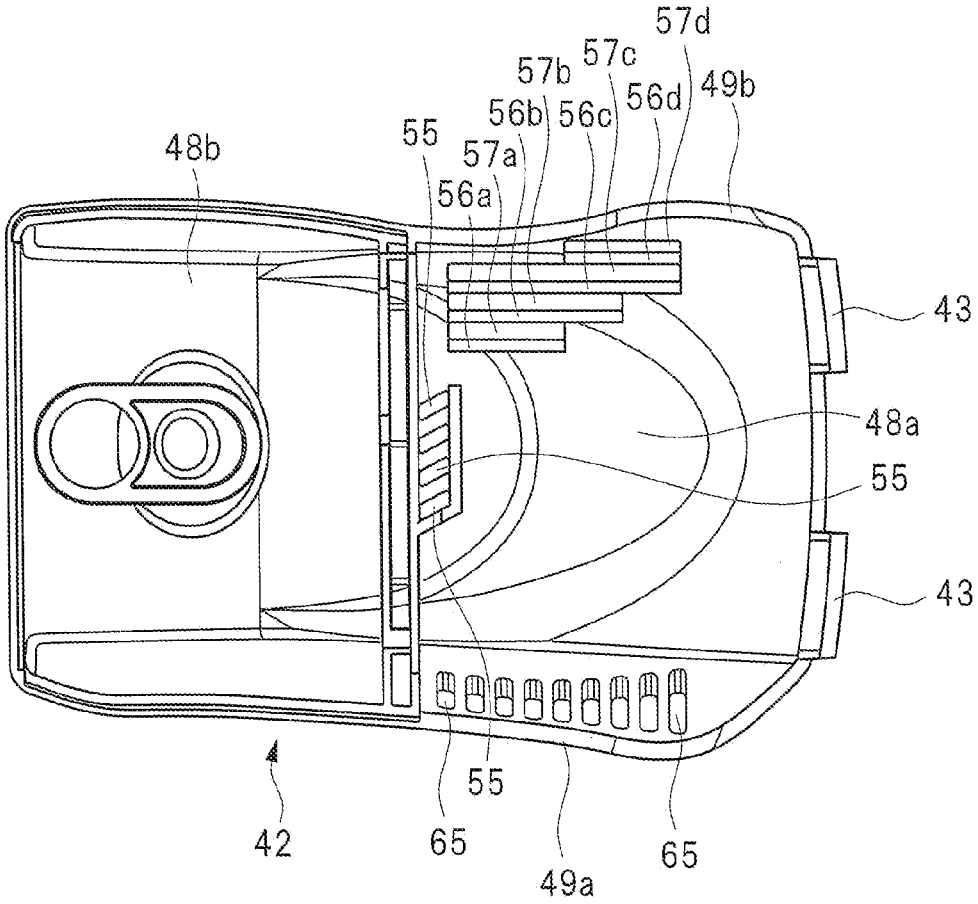
FIG. 15 is a plan view of FIG. 14.

As described above, the cylinder cover 42 configuring the engine cover 40 includes an inclined side wall part 49*a* which is inclined in a direction of spreading downward. Vent opening portions 65 are provided in the inclined side wall part 49*a* which is a side wall part on the cooling fan side, and each of the vent opening portions 65 is formed of a long hole extending in the up/down direction as illustrated in FIG. 13. The plurality of vent opening portions 65 are provided so as to be distant away from each other at a predetermined interval in the front/rear direction of the cylinder cover 42. As illustrated in FIG. 12, when the power tool main body 12 is put in the lateral standing state, that is, in the lateral orientation so that the crank shaft 13 is oriented in the up/down direction, the natural cooling air passes through the vent opening portions 65 as indicated by arrows "CA5". Since the vent opening portions 65 are provided in the inclined side wall part 49*a*, the vent opening portions 65 are oriented obliquely upward when the engine main body 11*a* is in a normal standing state.

Figure 10:
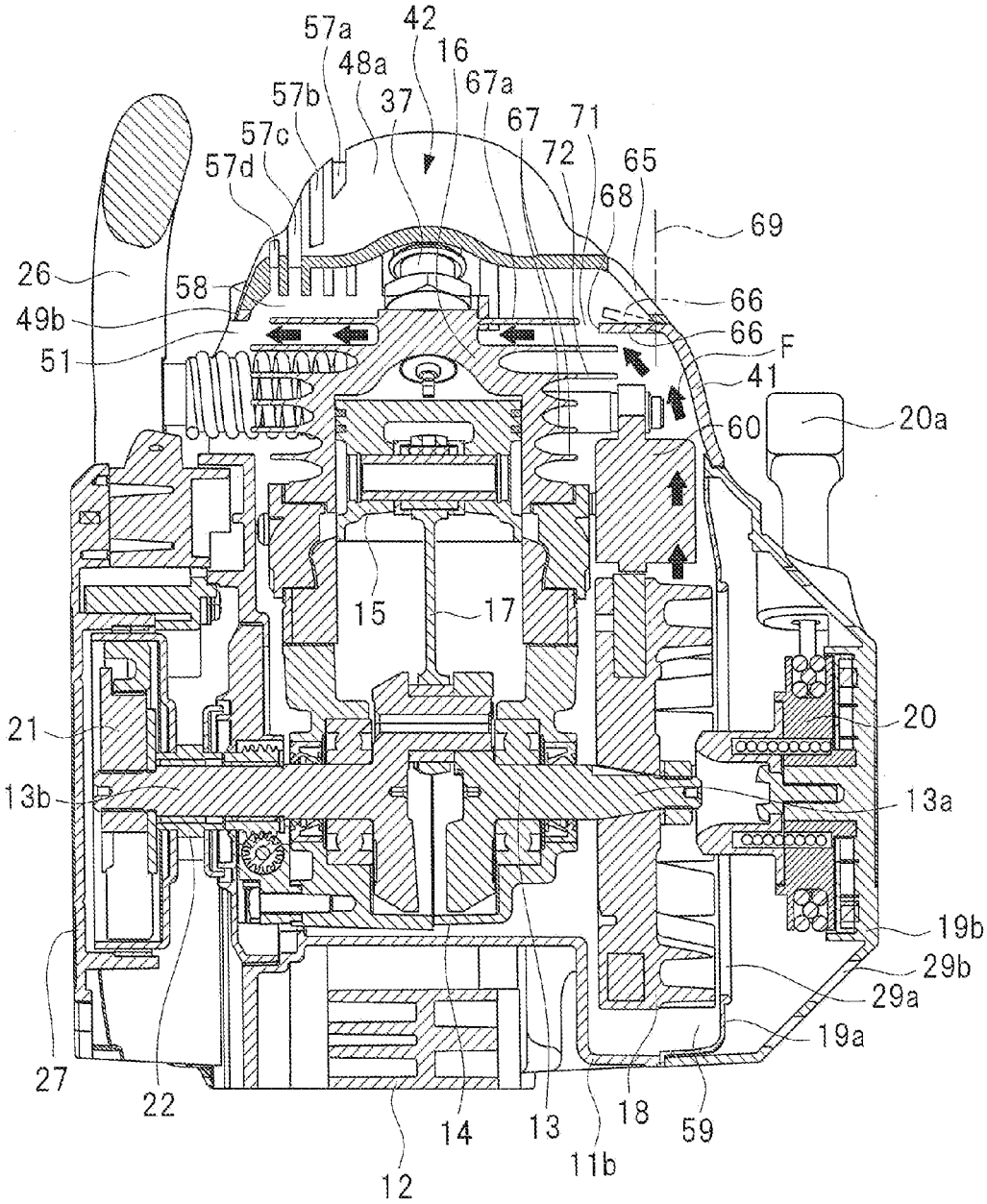
FIG. 10 is a cross-sectional view taken along a line D-D in FIG. 8, illustrating flow of cooling air in forced cooling in engine driving.
Figure 11:
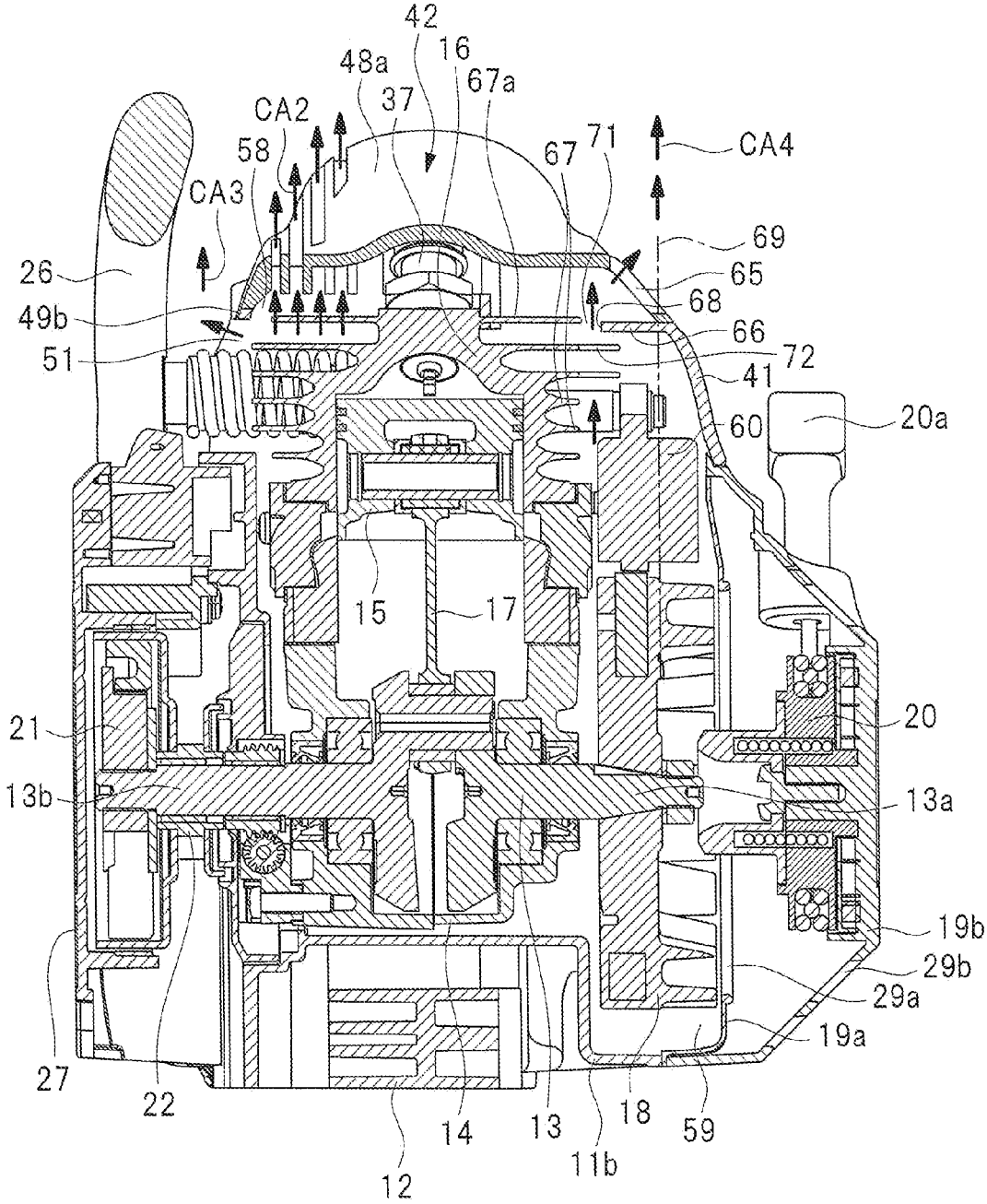
FIG. 11 is a cross-sectional view taken along the line D-D in FIG. 8, illustrating flow of cooling air in natural cooling in engine stop with putting the chain saw in a normal standing state.

As illustrated in FIGS. 10 to 12, a cover distal-end part 41 configuring the engine cover 40 is provided with an air guide 66 for guiding the forced cooling air generated by the cooling fan 18 toward the cylinder 16. This air guide 66 is arranged on the upstream side of the forced cooling air which is closer to the crank shaft 13 side than a top fin 67*a* among cylinder fins 67 of the cylinder 16, the top fin being provided at the uppermost part. As indicated by arrows F in FIG. 10, the forced cooling air flows along a portion lower than the top fin 67*a* and flows outside from the exhaust port 51. A tip 68 of the air guide 66 extends closer to the cylinder 16 side than a blade base part 69 of the cooling fan 18, and the forced cooling air is guided by the air guide 66 and is exactly guided toward the cylinder 16.

When the tip of this air guide 66 is inclined upward as indicated by a two-dot chain line in FIG. 10, a part of the forced cooling air flows along a space between the top fin 67*a* and the cylinder cover 42 as illustrated in FIG. 3. By changing an inclined angle of the air guide 66, a ratio between the forced cooling air flowing on an upper side of the top fin 67*a* and the forced cooling air flowing on a lower side thereof can be changed.

A space 71 is formed between the tip 68 of the air guide 66 and the top fin 67*a*. As illustrated in FIG. 11, this space 71 guides the natural cooling air flowing upward along the cylinder 16 to a portion upper than the top fin 67*a* with putting the power tool main body 12 in the normal standing state. As illustrated in FIG. 11, the natural cooling air passing through the space 71 is exhausted outside from the vent opening portion 65. A notch 72 is provided on a fin of the cylinder 16 so as to correspond to this space 71, and a passage of the natural cooling air communicating with the space 71 is formed with this notch 72. In this manner, the natural cooling air passing through the space 71 and flowing through the vent opening portion 65 is formed.

As illustrated in FIG. 10, the entire inner circumferential surface of the vent opening portion 65 is upper than the top fin 67*a*. However, if at least a part of the inner circumferential surface is upper than the top fin 67*a*, the natural cooling air can be exhausted outside.

The cooling operation for the engine in the engine driving will be explained. Since the crank shaft 13 is rotated, airflow F of the forced cooling air is generated by the cooling fan 18 as illustrated in FIG. 10, so that the forced cooling for the engine 11 is performed by this airflow. The airflow F is supplied from the volute chamber 59 and the cooling-air discharge port 18*a* to the engine cooling chamber 50. The forced cooling air flows upward to the spark plug 37, is guided toward the cylinder 16 by the air guide 66, and flows along the cylinder 16, so that the cylinder 16 is cooled. The forced cooling air after cooling the cylinder 16 is exhausted outside from the exhaust port 51 on a side cover 27 side. At this time, since the air guide 66 protrudes toward the cylinder 16 so as to cross between the vent opening portion 65 and the cooling fan 18, the vent opening portion 65 is completely covered with the air guide 66, and therefore, the forced cooling air is not leaked from the vent opening portion 65, and adverse effect of the vent opening portion 65 on the engine cooling is prevented. Since the tip 68 of the air guide 66 extends closer to the cylinder 16 than the blade base part 69 of the cooling fan 18, the upward leakage of the forced cooling air from the space 71 is prevented. Further, by guiding the forced cooling air to a lower side of the top fin 67*a* by the air guide 66, the airflow is not leaked outside from the opening portions 55 and 57*a* to 57*d*. Even if a part of the forced cooling air is guided to an upper side of the top fin 67*a*, the leakage of the airflow outside from the opening portions 55 and 57*a* to 57*d* is prevented by the air guiding rib.

As described above, in the engine driving, the engine 11 is effectively cooled. Also, since a portion of the cylinder fin 67 of the cylinder 16 except for the notch 72 extends closer to the side wall of the engine cover 40 than the tip 68 of the air guide 66, a heat radiation area is increased by the portion, and therefore, the cooling effect can be further increased.

Next, the cooling operation for the engine in the engine stop with putting the chain saw 10 in the normal standing state which is a normal operation state will be explained. In the engine stop, the crank shaft 13 does not rotate, and therefore, the cooling fan 18 does not rotate, either, and the airflow is not generated by the cooling fan 18. Therefore, the ascending air current at a high temperature is generated from the engine surface by the residual heat of the engine 11 whose temperature has been increased during the operation, so that the engine is cooled by the natural cooling air. At this time, the heat is conducted from the intake port 31 through the insulator 33 to the carburetor 34, so that the temperature of the carburetor 34 is increased. When the fuel is gasoline, most of gasoline components are vaporized at 55° C. to 60° C. Therefore, when a temperature of the carburetor 34 reaches 55° C. to 60° C., the fuel is immediately vaporized earlier than the supplying to the engine 11 even if the fuel is to be supplied from the fuel tank 62 to the carburetor 34, and therefore, it is difficult to sufficiently supply the fuel to the engine 11.

As illustrated in FIG. 11, in the illustrated chain saw 10, the natural convection is generated inside the engine cooling chamber 50. The natural cooling air "CA3" is the ascending air current at a high temperature generated from each fin of the cylinder 16, and is exhausted outside from the exhaust port 51 on the side cover 27 side of the cylinder cover 42. The natural cooling air "CA2" is the ascending air current at a high temperature mainly generated from the top fin 67*a*, and is exhausted outside from the opening portions 55 and 57*a* to 57*d* as similar to the case illustrated in FIG. 4. The natural cooling air "CA4" is the ascending air current generated from the top fin 67*a* and the cylinder fins 67. The space 71 is provided among the top fin 67*a*, the other cylinder fins 67, and the air guide 66, and besides, the passage of the natural cooling air is formed by the notch 72, and therefore, the natural cooling air CA4 smoothly moves upward to the engine cooling chamber 50. Since at least a part of the inner circumferential surface of the vent opening portion 65 is upper than the top fin 67*a*, the natural cooling air CA4 which has reached the cylinder cover 42 above the engine cooling chamber 50 is smoothly exhausted outside the engine cover 40 without staying in the upper part of the engine cooling chamber 50.

Figure 8:
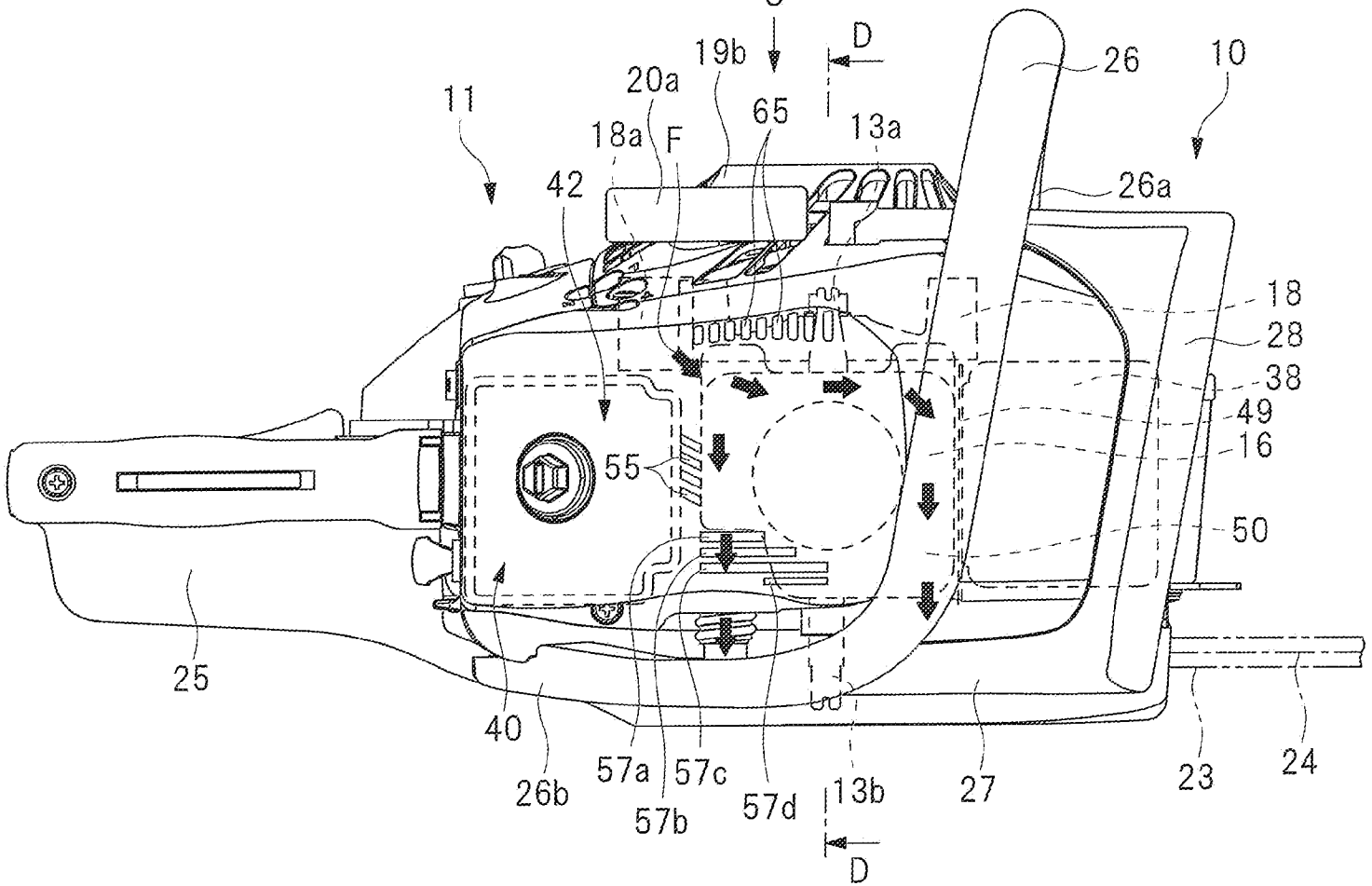
FIG. 8 is a plan view illustrating a chain saw serving as an engine power tool of another embodiment.

If the vent opening portion 65 is not provided in the cylinder cover 42, the ascending air current at the high temperature generated on the cooling fan 18 side of the cylinder 16 moves along the cylinder cover 42 to the side cover 27 side, and is merged with the natural cooling air CA2 and CA3, and then, is exhausted outside the engine cover 40. On the other hand, the natural cooling air CA4 which is the ascending air current at the high temperature generated on the cooling fan 18 side is immediately exhausted outside the engine cover 40 from the vent opening portion 65 on the cooling fan 18 side, and therefore, the cooling effect is extremely high. Further, the vent opening portion 65 does not overlap the front handle 26 in the up/down direction as illustrated in FIG. 8 and goes around toward the front side of the engine main body 11*a*, and therefore, the natural cooling air CA4 does not heat the front handle 26.

As described above, the natural cooling for the cylinder 16 which is a heat source in the engine stop can be significantly promoted, and therefore, heat quantity conducted through the insulator 33 to the carburetor 34 can be reduced, so that the increase in the temperature of the carburetor 34 can be suppressed.

Next, the cooling operation for the engine in the engine stop with putting the chain saw 10 in the lateral orientation will be explained. In the chain saw 10, the fuel tank cap 61 and the oil tank cap 63 are generally arranged on the cooling fan 18 side. Therefore, for example, when the fuel is supplied to the fuel tank 62, the chain saw 10 is often put on its side in the lateral orientation so that the side cover 27 is oriented downward as illustrated in FIG. 12. In this state, the natural cooling air "CA6" generated by the ascending air current at the high temperature generated from the cylinder 16 and the cylinder fins 67 moves upward along an inner surface of the engine cover 40, and then, is exhausted outside from the vent port 29*b* of the fan case 19*b*. This natural cooling air CA6 is largely deflected toward the vent port 29*b*, and this flow is not smooth. More particularly, if the spark coil 60 is attached to the cylinder 16 in order to make the engine 11 be compact, the flow of the natural cooling air CA6 is not smooth.

On the other hand, as illustrated in FIG. 12, the natural cooling air CA5 generated by the ascending air current at the high temperature generated from the top fin 67*a* goes straight upward without being exhausted from the opening portions 55 and 57*a* to 57*d*, and is exhausted outside from the vent opening portion 65. This flow of the natural cooling air CA5 is extremely smooth without interference of obstacle. Further, while vicinity of the spark plug 37 in the cylinder 16 is at the highest temperature, the natural cooling air CA5 which is the ascending air current at the high temperature generated from the spark plug 37 and the top fin 67*a* in the vicinity thereof is smoothly exhausted from the vent opening portion 65, and therefore, the engine cooling efficiency can be significantly improved. Still further, since the vent opening portion 65 does not overlap the front handle 26 in the up/down direction even when the chain saw 10 is in the lateral orientation, the natural cooling air CA5 exhausted from the engine cover 40 does not heat the front handle 26.

As described above, the natural cooling for the cylinder 16 which is the heat source in the engine stop can be significantly promoted even in the lateral orientation in which the side cover 27 is oriented downward, and therefore, the heat quantity conducted through the insulator 33 to the carburetor 34 can be reduced, and the increase in the temperature of the carburetor 34 can be suppressed.

The present invention is not limited to the foregoing embodiments and various modifications and alterations can be made within the scope of the present invention. For example, while the illustrated engine 11 is mounted on the chain saw 10 as the engine power tool, the illustrated engine can be also applied as an engine for a power cutter, and besides, can be applied to an engine for other engine power tool such as a brush cutter or a trimmer. In the engine 11 mounted on the chain saw 10, when the chain saw 10 is arranged above the base, while the crank shaft 13 is horizontally oriented, the engine main body 11*a* is oriented in the up/down direction. On the other hand, in an engine power tool in which an engine main body is mounted so as to be inclined with respect to a power tool main body or an engine power tool in which a crank shaft is mounted on a power tool main body so as to be oriented in the up/down direction, an opening portion and an air guiding rib are provided at a portion upper than top of a cylinder in a cylinder cover for covering the top of the cylinder when the engine power tool is arrange above the base.

What is claimed is:

1. An engine power tool including an engine main body including: a crank case in which a crank shaft is embedded so as to be rotatable and a cylinder in which a piston for rotating the crank shaft is embedded so as to be reciprocatable; and a power tool main body to which a rotating tool rotated by the crank shaft is attached, the engine power tool comprising:

a cooling fan which is attached to one protruding end of the crank shaft and which generates forced cooling air;

an engine cover in which an exhaust port for the forced cooling air is provided on the other protruding end of the crank shaft and which covers a top of the engine main body; and an air guiding rib which is provided on an inner surface of the engine cover so as to protrude therefrom and so as to extend in a direction of crossing the forced cooling air flowing along the cylinder from the protruding end of the crank shaft toward an opposite side thereof, wherein an opening portion which is formed so as to externally open a downstream side of the forced cooling air with respect to the air guiding rib is provided in the engine cover.

2. The engine power tool according to claim 1, wherein the opening portion is provided adjacent to a distal-end part of the air guiding rib on an engine cover side.

3. The engine power tool according to claim 1, wherein a plurality of the air guiding ribs and a plurality of the opening portions are provided in the engine cover.

4. The engine power tool according to claim 1,
wherein the engine power tool includes the opening portion and the air guiding rib opposite to an insulator attached to an intake port of the cylinder.

5. The engine power tool according to claim 1,
wherein the opening portion and the air guiding rib are provided on a downstream side of the forced cooling air lower than a spark plug.

6. The engine power tool according to claim 1,
wherein an opening portion and an air guiding rib on an upstream side are provided opposite to an insulator attached to an intake port of the cylinder, and an opening portion and an air guiding rib on a downstream side are provided on a downstream side of the forced cooling air lower than a spark plug.

7. The engine power tool according to claim 6,
wherein, with taking a center part of the engine cover in a width direction as a boundary, an area of the opening portion provided on the cooling fan side is smaller than an area of the opening portion provided on an opposite side to the cooling fan.

8. The engine power tool according to claim 1,
wherein a vent opening portion through which natural cooling air passes is provided on a side wall part of the engine cover on the cooling fan side, and an air guide for guiding the forced cooling air toward the cylinder so as to be closer to the cooling fan side than the vent opening portion is provided.

9. The engine power tool according to claim 8,
wherein a tip of the air guide extends closer to the cylinder side than a blade of the cooling fan.

10. The engine power tool according to claim 8,
wherein a space for guiding the natural cooling air to the vent opening portion is formed between the air guide and the cylinder.

11. The engine power tool according to claim 10,
wherein a notch is provided in a fin of the cylinder so that a flow path of the natural cooling air communicating with the space is formed by the notch.

12. The engine power tool according to claim 8,
wherein at least a part of an inner circumferential surface of the vent opening portion is provided upper than a top fin of the cylinder.

13. The engine power tool according to claim 8,
wherein the side wall part on the cooling fan side is inclined in a direction of spreading downward, and the vent opening portion is provided in the inclined side wall part.

14. The engine power tool according to claim 1,
wherein an operation handle is provided in the power tool body, the operation handle extending from the cooling fan side of the crank shaft to an opposite side of the crack shaft so as to across the engine cover through a space with respect to the engine cover, and each of the opening portions is provided on an opposite side of the operation handle through the crank shaft.

15. The engine power tool according to claim 1,
wherein a handle is arranged in the power tool body as going around each of the opening portions so that the handle and each of the opening portions do not overlap each other in an up/down direction and a width direction.

* * * * *